United States Patent [19]

Bordes

[11] 4,389,140

[45] Jun. 21, 1983

[54] LOCKING DEVICE FOR A PILE-SHAPED ELEMENT

[75] Inventor: Cornelis Bordes, Hardinxveld-Giessendam, Netherlands

[73] Assignee: Marine Structure Consultants (MSC) BV, Hardinxveld-Giessendam, Netherlands

[21] Appl. No.: 271,110

[22] Filed: Jun. 8, 1981

[30] Foreign Application Priority Data

Jun. 13, 1980 [NL] Netherlands ..... 8003462

[51] Int. Cl.[3] ..... E02B 17/08; E02D 21/00; B66F 1/00

[52] U.S. Cl. ..... 405/195; 405/198; 254/106

[58] Field of Search ..... 405/198, 199, 195; 254/106; 269/210

[56] References Cited

U.S. PATENT DOCUMENTS

| | | | |
|---|---|---|---|
| 2,589,146 | 3/1952 | Samuelson . | |
| 2,841,961 | 7/1958 | Lucas | 254/106 X |
| 2,873,580 | 2/1959 | Suderow | 405/199 |
| 3,058,189 | 10/1962 | Rechtin . | |
| 3,343,371 | 10/1967 | Heitkamp . | |
| 3,396,945 | 8/1968 | Schreier | 254/106 |
| 4,033,571 | 7/1977 | Wepner | 269/210 X |

FOREIGN PATENT DOCUMENTS

| | | |
|---|---|---|
| 24939 | 3/1981 | European Pat. Off. . |
| 272071 | 8/1964 | Netherlands . |

*Primary Examiner*—David H. Corbin
*Assistant Examiner*—Nancy J. Pistel

[57] ABSTRACT

Locking device for a pile-shaped element for a body having buoyancy and provided with a longitudinal rack adapted to coact with a pinion connected to the body. A rack piece connected with and displaceable relative to the body is adapted to coact with the longitudinal rack for mutually locking body and pile-shaped element. The rack piece has the shape of an isosceles trapezium along the large base side of which are provided the teeth and which is enclosed between two guide blocks which are displaceable both jointly and separately in longitudinal direction of the rack and each being provided with a guide face coacting with an inclined trapezium side of the rack piece.

6 Claims, 4 Drawing Figures

LOCKING DEVICE FOR A PILE-SHAPED ELEMENT

BACKGROUND AND SUMMARY OF THE INVENTION

The invention relates to a locking device for a pile-shaped element which in longitudinal direction is slidably received in a body having buoyancy and provided with at least one rack provided over at least a part of the length of the pile-shaped element, and which rack is adapted to coact with at least one pinion the drive and bearing of which are attached to the body having buoyancy, and having at least one rack piece connected to the body having buoyancy, said rack piece having a tooth profile adapted to engage and coact with the rack profile, whereby the rack piece is movable along at least half a tooth pitch in longitudinal direction and adapted to be brought in a direction perpendicular to the longitudinal direction of the rack beyond reach of the rack.

Such a locking device is disclosed in the non-prior pre-published European application No. 0,024,939 and is employed in a self-lifting platform for use at sea, which is provided with at least three legs. However, also other application possibilities are conceivable wherein a leg, pile or the like elongate element has to be locked relatively to a floating body. When using such devices, the legs may be brought into contact with the sea floor by driving the pinions, after which, in case of a self-lifting platform, by continuously driving the pinions, the platform is lifted to beyond reach of the waves. If the required height is attained, the platform is blocked relative to the legs by the engagement of the rack pieces in the longitudinal racks, so that the pinions can be relieved and are not exposed to forces that exceed the conventional lifting forces, while also the guides between the legs and the platform are loaded to a lesser extent and consequently can have a lighter construction. For bringing the rack piece in the locking position, it is movable by means of four screwed spindles, two of which defining the longitudinal displacement and two the meshing displacement. Through the longitudinal displacement the rack piece is positioned relative to the longitudinal rack in such a way that a tooth of the rack piece comes to lie opposite a tooth valley of the longitudinal rack and vice versa. After this positioning, the meshing displacement allows to realize the locking proper. The bringing in the locking position of the rack piece is effected consequently by two different displacement devices, which is to be considered elaborate and time-consuming, while not only two different drives should be present, but also separate controls therefor.

It is the object of the invention to eliminate the above drawbacks by providing a simpler device, which moreover is adapted for quicker operation.

This is achieved in accordance with the invention in a locking device of the type described in the above when the rack piece comprises a plate of a substantially isosceles trapezium-shaped circumference with the teeth disposed along the large base side of the trapezium, whereby the rack piece is enclosed between two guide blocks which both jointly and separately are displaceable in longitudinal direction of the rack, and each being provided with a guide face adapted to coact with one of the inclined trapezium sides of the rack piece. by these features likewise a meshing displacement can be realized by means of only one longitudinal displacement device. For the approaching movement of the guide blocks enables a possibly pure-meshing displacement, while a uniform displacement in the same direction of the guide blocks enables to realize a longitudinal displacement. By displacing the one block quicker than the other, even a combined longitudinal and meshing displacement is possible, and thus an optimally quick locking.

The displacement of the guide blocks may take place in different manners, e.g. with cylinders. According to a further embodiment of the invention, however it is preferable that the guide blocks are each displaceable by at least two screwed spindles, while said screwed spindles are arranged in such a way that the center lines of the one set of screwed spindles coincides with those of the other set and each pair of screwed spindles with coinciding center lines is connected rotatably relative to each other. Thus, an accurately guided displacement of the guide blocks is achieved, while the self-braking effect of a screw connection needs an additional protection. By connecting a set of screwed spindles with coinciding center lines rotatably relative to each other, there is advantageously effected a locking in longitudinal direction.

When in accordance with a further embodiment of the invention, the inclination of the guide faces is equal to the pressure angle of the teeth, the tooth forces are transmitted advantageously without additional force onto the guide blocks. The transmission forces can be resolved into a vertical and a horizontal component, the vertical component being discharged via the displacement device of the guide blocks towards the body with buoyancy, while the horizontal component, via guide faces between the guide blocks and the body with buoyancy, is transmitted directly thereto.

One embodiment of the locking device according to the invention will now be explained, by way of example, with reference to the diagrammatic drawing, in which

BRIEF DESCRIPTION OF THE DRAWINGS

FIG. 1 shows a part of a lifting platform 1 wherein a passage 2 is provided for a leg 3. Two toothed racks 4 extend in longitudinal direction of the leg 3 on either side thereof. The leg 3 may have any desired construction or cross-section. For instance, the leg 3 may be a lattice leg consisting of a plurality of elongate standards interconnected by cross-rods, each standard being provided with one or a plurality of toothed racks. Further possible constructions for the legs are cross-sectionally round, square or differently shaped tubes.

Figure 1:
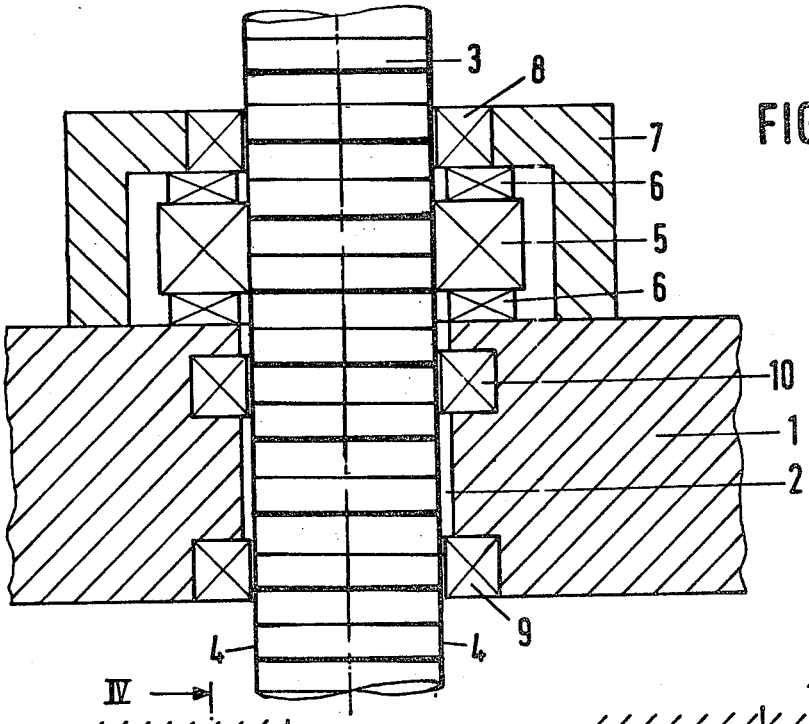
FIG. 1 is a cross-section of a part of a lifting platform in situ of one of the piles.

With each toothed rack 4 can mesh one or a plurality of pinions for displacing the leg 3 relative to the platform 1. The pinions are accommodated in drive mechanisms 5, which find support via spring packets 6 on the one end against the lifting platform 1 and on the other end against a yoke 7, which is rigidly connected to the lifting platform 1. In order to maintain a proper positioning of the leg relative to the lifting platform, there are provided a pair of spaced apart guides 8 and 9. For effectively locking and securing the leg 3 relative to the lifting platform 1, there is mounted adjacent each toothed rack 4 a locking device 10 according to the invention, which locking device 10 will be further explained and elucidated in the following with reference to FIGS. 2–4.

The locking device 10 is provided with a rack piece 11 comprising a plate-like portion having substantially an isosceles trapezoidal circumference, whereby along the large base side thereof there is provided a gearing 12 adapted to coact with the gearing of the opposite toothed rack 4. The short side of the rack piece 11 extends parallel to an adjacent portion of the lifting platform 1. The two slanting sides of the rack piece 11 have a gradient that corresponds with that of the gearings. Furthermore the two slanting sides are provided with flanged edges 13 which are slidably retained in guide members 14 forming part of guide blocks 15. In these guide blocks 15, which consist of a block-shaped piece of material provided with a sloping face that corresponds with the coacting face of the rack piece 11, there are provided each time a pair of threaded bores for receiving screwed spindles 16, 17. In alignment with a screwed spindle 16 is each time positioned a screwed spindle 17, whereby between both screwed spindles there is positioned a spacer 18 consisting of a shaft-like portion having a center line that coincides with that of the two screwed spindles 16, 17. An assembly of a screwed spindle 16, a spacer 18 and a screwed spindle 17, secured against displacement in longitudinal direction, is received between two rigidly interconnected parts of the lifting platform 1. By means of bearings 19, the screwed spindles 16 and 17 are rotatably mounted relative to the lifting platform 1 and by means of bearings 20 relative to the spacers 18, or relative to each other. The screwed spindles 16, 17 are rotatable by means of driving gear, not shown. Each set of screwed spindles 16, 17 is coupled mutually, so that each set of screwed spindles 16, 17 is rotated at the same angular speed. The set of screwed spindles 16 of each locking device 10 should be adapted thereby for rotation independently of the set of screwed spindles 17 of said locking device 10.

The operation of the above described device is as follows.

When the lifting platform 1 has arrived at the proper location, the legs 3 are brought downwards by means of the drive mechanisms 5 until these reach the floor. Through the further operation of the drive mechanisms 5, the lifting platform 1 is subsequently moved upwards along the legs until the required distance above the water surface is attained. During these mutual movements of legs 3 and platform 1, the securing devices 10 are in the position shown in FIG. 2, while the guides 8, 9 ensure that a leg 3 is guided properly relative to the lifting platform 1.

Figure 2:
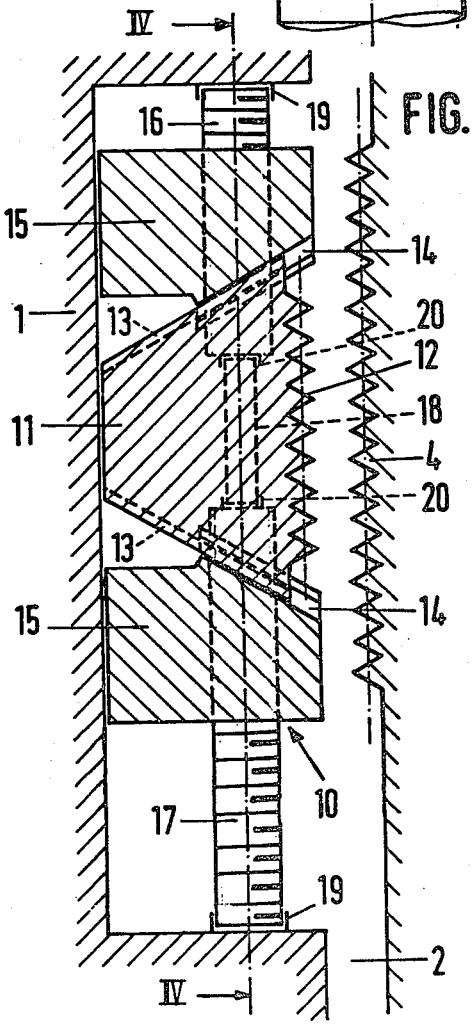
FIG. 2 shows a locking device according to the invention in the non-blocking position.
Figure 3:
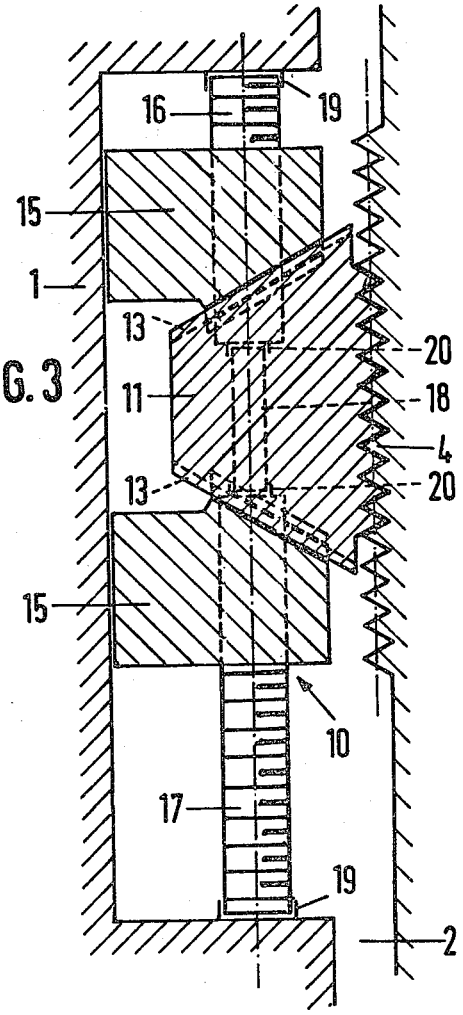
FIG. 3 shows the locking device according to FIG. 2 in the blocking position.
Figure 4:
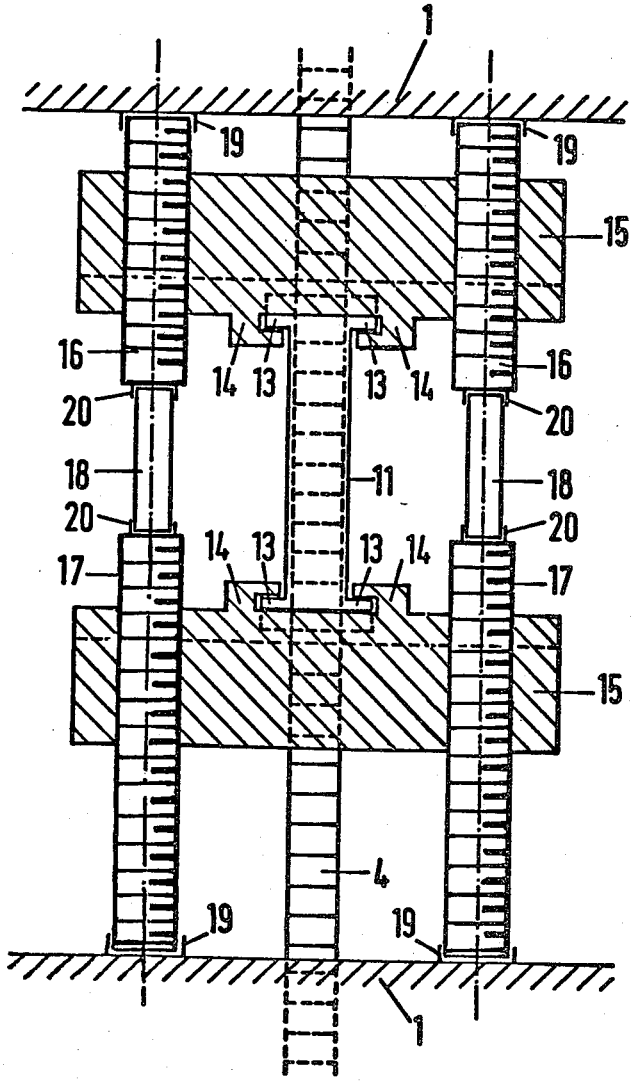
FIG. 4 is a cross-section on the line IV—IV in FIG. 2.

In order to relieve the guides 8, 9 and the drive mechanisms 5 in the resulting lifted position as much as possible of forces and moments originating from the piles, e.g. during a heavy storm, the locking devices are brought from the position shown in FIG. 2 in the position shown in FIG. 3, which is effected by suitably driving the screwed spindles 16 and 17. By simultaneously rotating the screwed spindles 16 and 17 at the same speed, the teeth of the rack piece 11 can be properly positioned relative to the teeth of the toothed rack 4. By rotating the screwed spindles 16 and 17 at equal speed in opposite direction, the rack piece 11 can be pressed towards the leg 3 without changing the position of the gearings relatively to each other. Naturally it is also possible, by a suitable control, to rotate the screwed spindles 16, 17 at different speeds so that the rack piece 11 is smoothly brought in engagement with the toothed rack 4.

By arranging two toothed racks 4 as well as two locking devices 10 oppositely each other, a particularly effective gripping of the legs 3 can be effected.

In the embodiment shown, the gradients of rack piece 11 and guide blocks 15 are chosen equal to the pressure angles of the gearings. As a result, it is advantageously effected that the forces originating from the piles are transmitted without additional forces to the guide blocks 15. These forces can be thought resolved into a vertical and horizontal component. The vertical component is transmitted via the screwed spindles 16, 17 to the frame of the lifting platform 1. The horizontal component on the other hand is directly transmitted from a guide block 15 onto the adjacent portion of the lifting platform 1.

It is self-evident that within the scope of the invention many amendments and variants are possible. For instance, the guide blocks 15 may be moved instead of by screwed spindles, by hydraulic or pneumatic cylinders. Although it is preferable that the angles of inclination of the rack piece and the guide blocks are equal to the pressure angle of the gearings, said angles, if desired, may also have a different value. Furthermore it is possible, instead of sliding the rack piece 11 in the plane of drawing in FIG. 2 towards the toothed rack 4, to displace same perpendicular thereto. Then there should be provided a device for displacing the rack piece in longitudinal direction of the toothed rack for positioning the gearings relative to each other and a device for displacing the rack piece 11 perpendicular to the plane of drawing in order to bring the rack piece beyond engagement with the toothed rack. An advantage of this construction is that the rack piece 11 then remains always in contact with a frame portion of the lifting platform 1, so that the horizontal component of the forces to be transmitted can be transmitted via the rack piece directly onto the frame of the lifting platform 1. In such case, the rack piece may be a rectangular plate having a gearing disposed along one side edge.

In the above, there has always been question of a lifting platform provided with legs. This should not be considered to be a restriction of the application range of the locking device according to the invention.

I claim:

1. A locking device for an elongated pile-shaped element of the type slideably received in the longitudinal direction in a body having buoyancy, said locking device comprising:

at least one toothed rack having a plurality of teeth associated with at least a portion of said pile-shaped element in the longitudinal direction;

at least one locking means associated with said body for lockably engaging a predetermined portion of a said toothed rack, said locking means defining a substantially isosceles trapezoidal structure having gear teeth disposed along the large base of said structure in opposing relationship to said toothed rack and having first and second opposing substantially smooth surfaces each gradiently disposed between the small base of said trapezoidal structure and said large base, said locking means being movable between a first position wherein said gear teeth are in a non-engaging relationship with said toothed rack and a second position wherein said gear teeth are in an engaging relationship with said toothed rack;

guide means for moving said locking means relative to said toothed rack including first guide block means defining a first bearing surface in constant contacting relationship with said first smooth surface during movement of said at least one locking means between said first and second positions, and second guide block means defining a second bearing surface in constant contacting relationship with said second smooth surface during movement of said at least one locking means between said first and second positions; and displacing means for jointly or separately displacing each of said first and/or second guide block means vertically and at predetermined rates of speed relative to one another, and for controllably and responsively displacing said locking means horizontally and/or vertically relative to said toothed rack by virtue of the constant contacting relationship of said first and second bearing surfaces with said first and second smooth surfaces, respectively, whereby said gear teeth of said locking means are controllably directed in horizontal and/or vertical directions relative said pile-shaped element to effect locking relationship thereof with said toothed rack.

2. A locking device as in claim 1 wherein said displacing means comprises at least one set of vertically opposing threaded spindles, one of said spindles being threadably engageable with said first guide block means, and the other of said spindles being threadably engageable with said second guide block means so that rotational movement of either said one or the other of said spindles responsively effects vertical displacement of said first or second guide block means, respectively.

3. A locking device as in claim 1 further comprising spacer means axially disposed between said at least one spindle set.

4. A locking device as in claims 2 or 3 further comprising bearing means for permitting independent rotational movement of said one or the other spindles relative to one another.

5. A locking device as in claim 1 wherein two sets of spindles are provided, said locking means being disposed intermediate said two sets.

6. A locking device as in claim 1, 2 or 3 wherein each of said teeth of said toothed rack includes a predetermined pressure angle and wherein each of the gradients of said first and second bearing surfaces is equal to said pressure angle.

* * * * *